United States Patent [19]

Lyons

[11] Patent Number: 4,948,636

[45] Date of Patent: Aug. 14, 1990

[54] DECORATIVE BOW AND METHOD OF MAKING THE SAME

[75] Inventor: Jeffrey Lyons, Aldan, Pa.

[73] Assignee: Delaware Ribbon Manufacturers, Inc., Philadelphia, Pa.

[21] Appl. No.: 421,185

[22] Filed: Oct. 13, 1989

[51] Int. Cl.[5] ..... D04D 7/10

[52] U.S. Cl. ..... 428/5; 28/147; 223/46

[58] Field of Search ..... 428/4, 5; 2/151; 28/147; 223/46; 493/955

[56] References Cited

U.S. PATENT DOCUMENTS

| | | | |
|---|---|---|---|
| 2,587,502 | 2/1952 | McMahon | 428/5 |
| 2,681,525 | 6/1954 | James | 223/46 X |
| 3,041,765 | 7/1962 | Paar | 428/5 |
| 3,954,212 | 5/1976 | Bolis | 223/46 |
| 4,339,059 | 7/1982 | Kenyon | 428/5 X |

*Primary Examiner*—Henry F. Epstein

*Attorney, Agent, or Firm*—Z. T. Wobensmith

[57] ABSTRACT

A decorative bow and method of making the same wherein the bow is formed from one or more continuous lengths of ribbon that in manufacturing is trimmed, folded, punched, and stapled to a card with the trailing edges cut and which upon fanning forms a bow having one or more integral legs that make up the tail.

2 Claims, 2 Drawing Sheets

FIG. 1
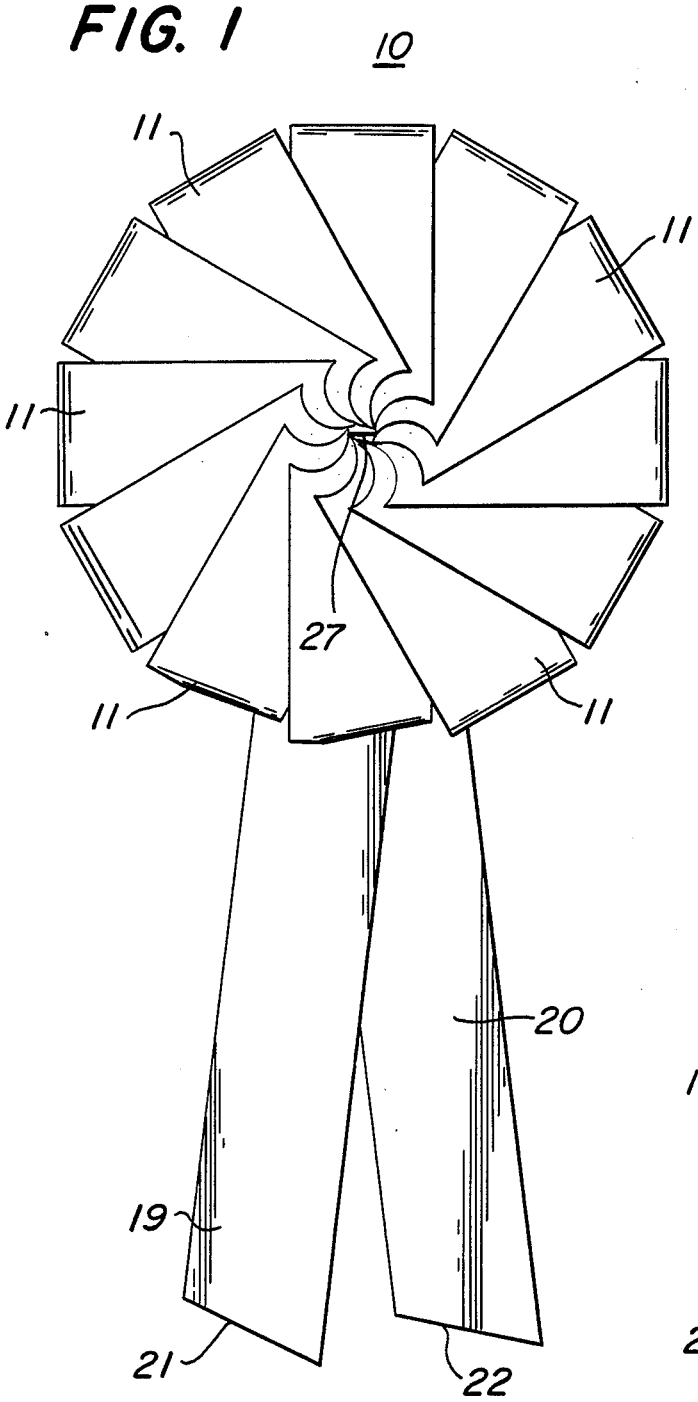
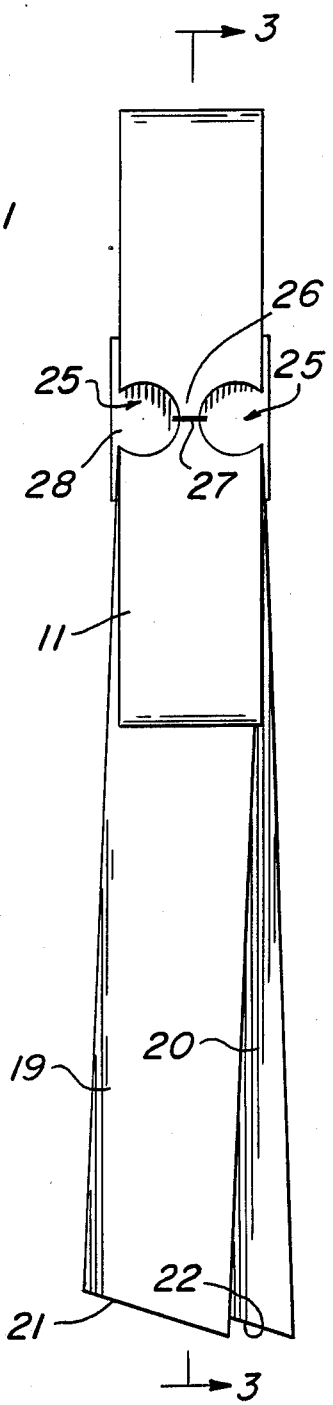
FIG. 2

FIG. 4
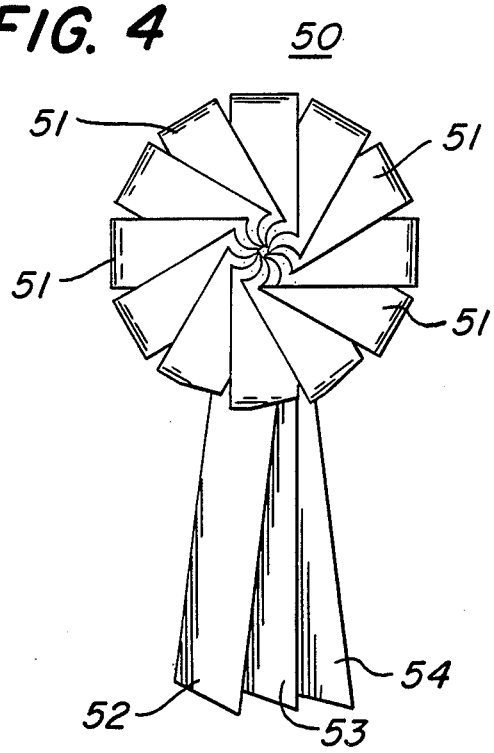
FIG. 3
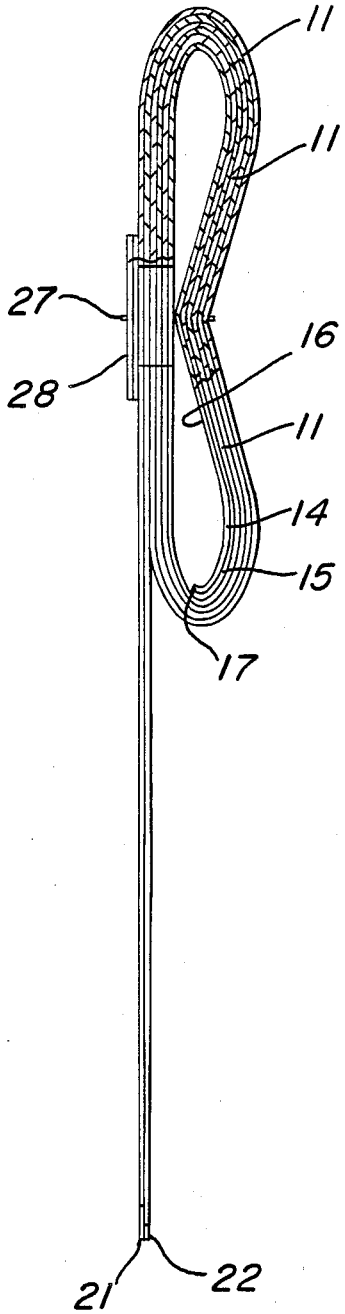
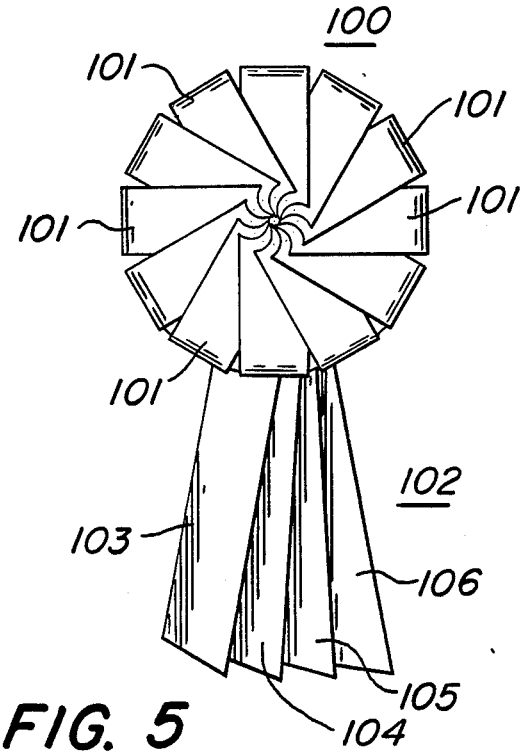
FIG. 5

DECORATIVE BOW AND METHOD OF MAKING THE SAME

BACKGROUND OF THE INVENTION

1. Field of the Invention

This invention relates to a decorative bow and method of making the same, which bow is of the ribbon type with one or more integral legs forming a tail.

2. Description of the Prior Art

The need for decorative bows which has tails has long been recognized in the bow industry. Bows of ribbon which are typically of polyester ribbon, in production, are formed by folding or wrapping lengths of ribbon, which are then punched or die cut in the middle to remove a portion of ribbon and then stapled to a card. The die cutting allows the ribbon lengths after assembly to be fanned about the middle, where they are attached to the card, and to be formed into a finished bow for application to a package or the like. The common practice in the industry has been to form the tail of strips of ribbon cut to length, which are not part of the folded lengths, and which must be separately retained and fastened to the card. Such tails are difficult to handle, difficult to properly secure and retain, require extra manufacturing operations, and do not always present an attractive appearance.

The bow of the invention has an integral tail, is easy to manufacture and overcomes the shortcomings of prior bows.

SUMMARY OF THE INVENTION

A decorative bow and method of making the same, wherein ribbon is strip form is trimmed, folded about itself into loops, attached to a card, die cut and trimmed, with the bow formed by fanning the loops, and with the tail formed at the trailing ends of the ribbon which forms the bow.

The principal object of the invention is to provide a decorative bow and method of making the same which provides the bow with one or more integral legs which provide the tail.

A further object of the invention is to provide a bow and method as aforesaid wherein bows of different size, and with tails of different length are easily fabricated.

A further object of the invention is to provide a bow and method as aforesaid which provides a product of superior durability and of quality appearance.

Other objects and advantageous features of the invention will be apparent from the description and claims.

BRIEF DESCRIPTION OF THE DRAWINGS

The nature and characteristic features of the invention will be more readily understood from the following description taken in connection with the accompanying drawings forming part hereof, in which:

FIG. 1 is a plan view of one embodiment of a decorative bow constructed in accordance with the method of the invention, in assembled condition;

FIG. 2 is a plan view of one embodiment of a decorative bow constructed in accordance with the method of the invention, prior to forming into a finished bow;

FIG. 3 is a vertical sectional view taken approximately on the line 3—3 of FIG. 2;

FIG. 4 is a plan view in reduced scale of another embodiment of decorative bow, constructed in accordance with the method of the invention, and in assembled ready to use condition; and FIG. 5 is a plan view in reduced scale of still another embodiment of decorative bow, constructed in accordance with the method of the invention and in assembled ready to use condition.

It should, of course, be understood that the description and drawings herewith are illustrative merely and that various modifications and changes can be made in the structure disclosed without departing from the spirit of the invention.

Like numerals refer to like parts throughout the several views.

DESCRIPTION OF THE PREFERRED EMBODIMENTS

Referring now more particularly to the drawings and FIGS. 1 to 3 thereof, one embodiment of decorative bow 10 is illustrated. The bow 10 is comprised of a plurality of loops 11 of ribbon which are shown as being double loops, and which provides a two legged tail 12. In manufacturing a bow, ribbon from a continuous roll is fed in two layers 14 and 15 into a ribbon forming machine, (not shown) where the leading edges 17 are grabbed and a continuous series of loops 11 are formed by wrapping successive layers of ribbon about the first loop 16. The tail 18 of two pieces 19 and 20, is formed by not wrapping the last loop of ribbon, and the double layer of ribbon are trimmed at an angle to the centerline of the ribbon length to form trailing edges 21 and 22. When sufficient loops 11 of ribbon have been wrapped or wound, the loops 11 are die cut, forming two half circles 25 connected by a bridge 26 and then fastened by a staple 27 to a card 28. The finished product 10 is shown in FIG. 2, ready for fanning of loops 11 into a finished bow. The card 28 is of paper and may be provided with a pressure sensitive coating (not shown) on the side opposite to loops 11, so that the card 28 can be attached to a package (not shown). FIG. 1 illustrates the bow 10 of FIGS. 2 and 3 in fanned condition ready for attachment to a package.

Referring now more particularly to FIG. 4 another embodiment of decorative bow 50 is formed as described for bow 10, but three stacked layers or strips of ribbon are fed into the machine (not shown) at one time, which does not require as many loops 51 to form the bow 50, and which provides a tail having three legs 52, 53 and 54.

Referring now more particularly to FIG. 5, another embodiment of bow 100 is therein illustrated. The bow 100 is constructed as described for bow 10 except that four stacked layers or strips of ribbon are fed into the machine (not shown) at one time, which does not require as many loops to form the bow 100 and which provides a tail 102 having four legs 103, 104, 105 and 106.

Other variations of bows can be formed with patterns as desired, by using ribbon of different colors and/or patterns with the number of legs for the tail limited by the number of stacked layers of ribbon.

It will thus be seen that a decorative bow and method for making the same has been described with which the objects of the invention are attained.

I claim:

1. A decorative bow having a tail which comprises
at least one loop of ribbon of at least one layer having successive loops wrapped around it,
said loops having cut outs at the center to form a bridge with the cut outs on each side thereof,
said bridge is fastened to a card, and
said last loop is not wrapped but cut at its end to form an integral tail having at least one leg.

2. A decorative bow as defined in claim 1, in which said card is provided with an adhesive backing.

* * * * *